US005343932A

United States Patent [19]

Williams et al.

[11] Patent Number: 5,343,932

[45] Date of Patent: Sep. 6, 1994

[54] SYSTEM FOR FEEDING MOLTEN METAL STREAM TO CONTINUOUS STRAND CASTER

[75] Inventors: Tabb H. Williams; Robert B. Augustine, III, both of Richmond; James L. Kirby, Mechanicsville, all of Va.

[73] Assignee: Reynolds Metals Company, Richmond, Va.

[21] Appl. No.: 53,781

[22] Filed: Apr. 26, 1993

[51] Int. Cl.[5] ..... B22D 11/06; B22D 11/18

[52] U.S. Cl. ..... 164/449.1; 164/450.5

[58] Field of Search ..... 164/449, 450, 417, 434, 164/433, 437, 439, 155, 453

[56] References Cited

U.S. PATENT DOCUMENTS

| | | | |
|---|---|---|---|
| 2,757,425 | 8/1956 | Duncan et al. | 164/437 X |
| 2,962,778 | 12/1960 | Peak et al. | 164/450 |
| 3,431,971 | 3/1969 | Gyongyos | 164/434 |
| 4,276,921 | 7/1981 | Lemmens et al. | 164/449 X |
| 4,277,281 | 7/1981 | Weber et al. . | |
| 4,334,990 | 6/1982 | du Manoir de Juaye et al. . | |
| 4,531,717 | 7/1985 | Hebrant . | |
| 4,567,935 | 2/1986 | Takeda et al. . | |

FOREIGN PATENT DOCUMENTS

| | | | |
|---|---|---|---|
| 3538448 | 12/1986 | Fed. Rep. of Germany | 164/434 |
| 61-14059 | 1/1986 | Japan | 164/449 |
| 3-210946 | 9/1991 | Japan | 164/449 |
| 4-200960 | 7/1992 | Japan | 164/453 |

OTHER PUBLICATIONS

"Aluminum Casting Principles", *Metals Engineering Institute*, American Society for Metals (1979), pp. 5–12.

*Primary Examiner*—J. Reed Batten, Jr.

*Attorney, Agent, or Firm*—Alan M. Biddison

[57] ABSTRACT

Molten metal fed to a rotating casting wheel is controlled by a vertical pouring spout feeding a tundish below it, a trough from the tundish to the wheel, a sensor to detect the level of metal in the trough, a pin controlled by the sensor to adjust flow through the spout, and a foraminous receptacle in the tundish to receive the flow from the spout and passivate the outflow on its way to the sensor.

5 Claims, 4 Drawing Sheets

SYSTEM FOR FEEDING MOLTEN METAL STREAM TO CONTINUOUS STRAND CASTER

FIELD OF THE INVENTION

The invention relates to controlling the feeding of a stream of molten metal to a peripheral groove around a rotating casting wheel for producing a single strand of metal, as in the case of Properzi continuous casters.

BACKGROUND OF THE INVENTION

Strands of conductive metals, such as aluminum and copper and their respective alloys, are often produced to any desired length and shipped in coils for use in electric transmission lines, for example. A process for this purpose, such as the Properzi process, comprises continually feeding a stream of molten metal into a peripheral groove near the top of a chilled casting wheel as it rotates, covering the part of the groove where the metal solidifies with a traveling belt over the groove, removing the solidified metal from the casting wheel and passing it through forming rolls while under tension, and coiling the resultant metal strand.

Feeding the molten metal onto the casting wheel groove requires care. Overfeeding can overflow the groove and halt the process, and underfeeding can cause voids in the solidified strand which can halt the process by breaking the strand during rolling. Conventional equipment for the process comprises an upper tundish to receive an incoming stream of molten metal; a lower tundish receiving molten metal through a downspout from the upper tundish; a trough extending laterally from the lower tundish to convey molten metal into the casting groove; and a baffle beneath the spout which floats on the molten metal in the lower tundish. As the level of molten metal in the lower tundish rises the baffle rises to reduce the inflow from the spout, and as the metal level falls the baffle moves away from the spout and thereby increases the inflow of molten metal from the spout, thus tending to automatically keep the level reasonably constant under a given set of constant operating conditions.

While a floating baffle works successfully under a given set of operating conditions, it is not adjustable during operation to vary the rate of outflow from the spout independently of the level of molten metal in the trough which feeds into the casting groove; for example, when the level should be higher to more entirely fill the groove, or when the speed of rotation of the casting wheel is altered.

SUMMARY OF THE INVENTION in accordance with the present invention the conventional floating baffle is replaced by the combination of a monitoring device responsive to changes of level of molten metal through measurement of changes of phenomenal which vary as the level varies, without need for contact with the molten metal; means controlled by the monitoring device for controlling the rate of flow through the downspout; and a foraminous receptacle mounted in the chamber beneath the spout and capable of diffusing flow of molten metal into the chamber with substantially no accompanying action of filtering out solid particles in the molten metal. Replacing the conventional floating baffle without substitution of such a receptacle leads to excessive turbulence on the molten metal leaving the chamber beneath the spout and consequent interference with level measurements made by the monitoring device.

BRIEF DESCRIPTION OF THE DRAWINGS

A present preferred embodiment of the invention is shown, for purposes of illustration only, in the accompanying semi-schematic drawings, as follows.

DESCRIPTION OF PRESENT PREFERRED EMBODIMENT OF THE INVENTION

Figure 1:
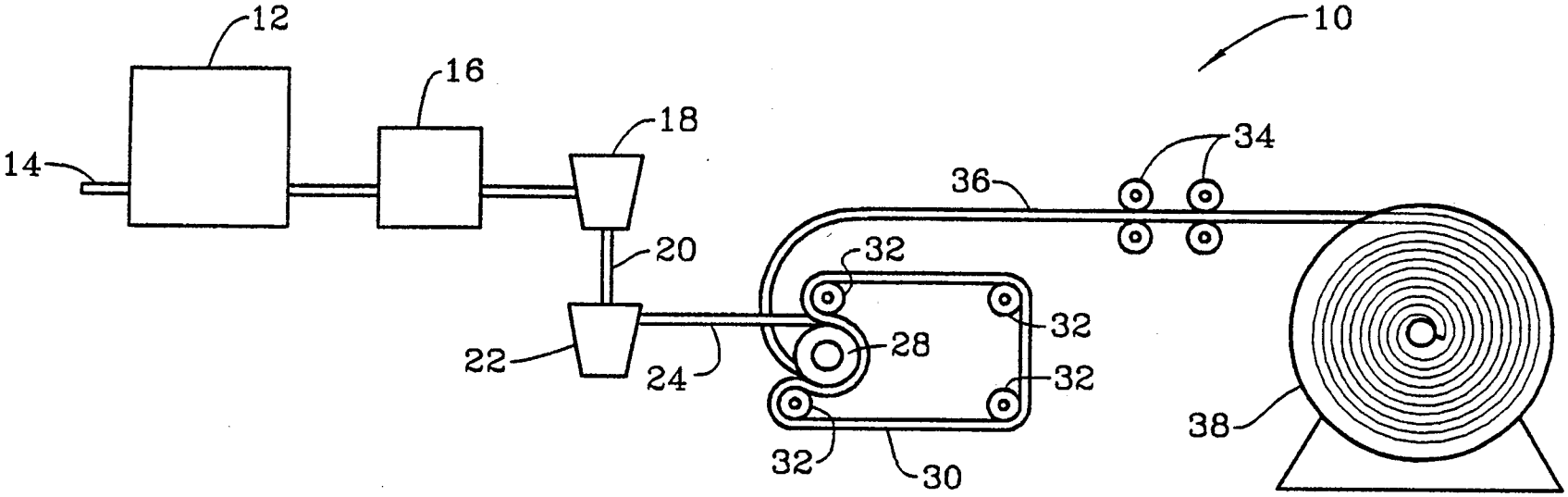
FIG. 1 shows apparatus for continuously feeding molten metal to the peripheral groove of a rotating casting wheel and rolling and coiling the resultant cast strand of metal.
Figure 3:
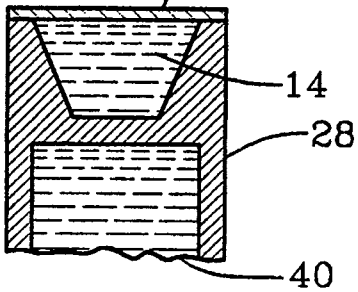
FIG. 3 corresponds to FIG. 2 but shows the wheel after the groove has received molten metal and been covered by a metal band to retain the molten metal.
Figure 2:
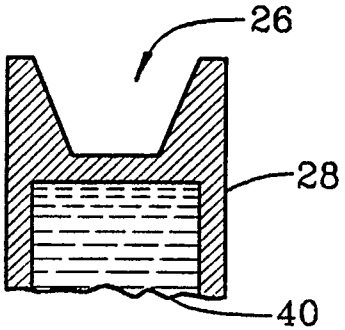
FIG. 2 shows a vertical section through the axis of rotation of the casting wheel of FIG. 1, enlarged and broken away to show a top portion of the groove around the wheel before it receives molten metal.

Referring now more particularly to the accompanying drawings, the metal strand production apparatus 10 shown in FIG. 1 comprises a holding furnace 12 which receives molten metal 14 from one or more melting furnaces (not shown); means 16 for removing solid and gaseous impurities from the metal 14; an upper tundish or other chamber 18 which receives a stream of the molten metal 14 from the treating means 16; a downspout 20 which conveys a stream of molten metal from upper tundish 18 into a lower tundish 22; a lateral trough 24 which channels molten metal 14 from lower tundish 22 into a peripheral groove 26 (FIG. 2) around a chilled rotating casting wheel 28, near the top of the wheel where to groove is uncovered to receive the incoming molten metal; a traveling belt 30 which is trained around rollers 32 to bear against casting wheel 28 and thereby cover groove 26 along the portions of the groove where the molten metal is solidified by contact with the chilled casting wheel; a plurality of forming roll stands 34 which shape and apply tension to a strand 36 of cast metal emerging from the groove 28; and a coiler 38 to coil the strand 36 after it has passed through the rolled stands 34. The casting wheel 28 is hollow and filled with cold water 40 which is constantly supplied and withdrawn through connections not shown. The portions of the system which are described above in connection with FIGS. 1–3 are conventional, and are generally representative of the operation of well known forms of Properzi metal strand casters.

Figure 4A:
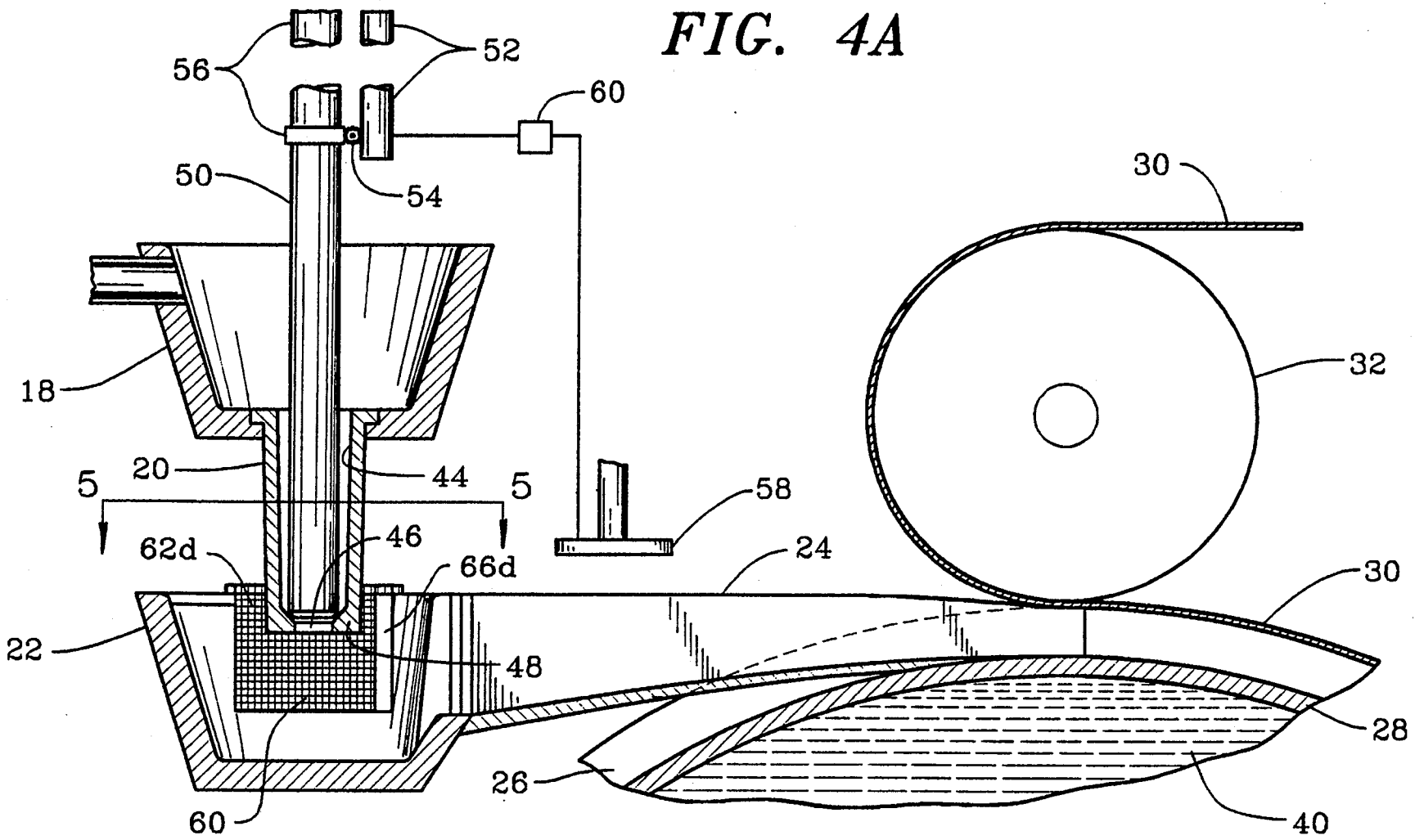
FIG. 4A shows an enlarged and broken-away vertical lengthwise section through the casting wheel and the vertically arranged pair of molten metal feeding means next to the wheel, and shows the flow control means, before molten metal enters the system.
Figure 4B:
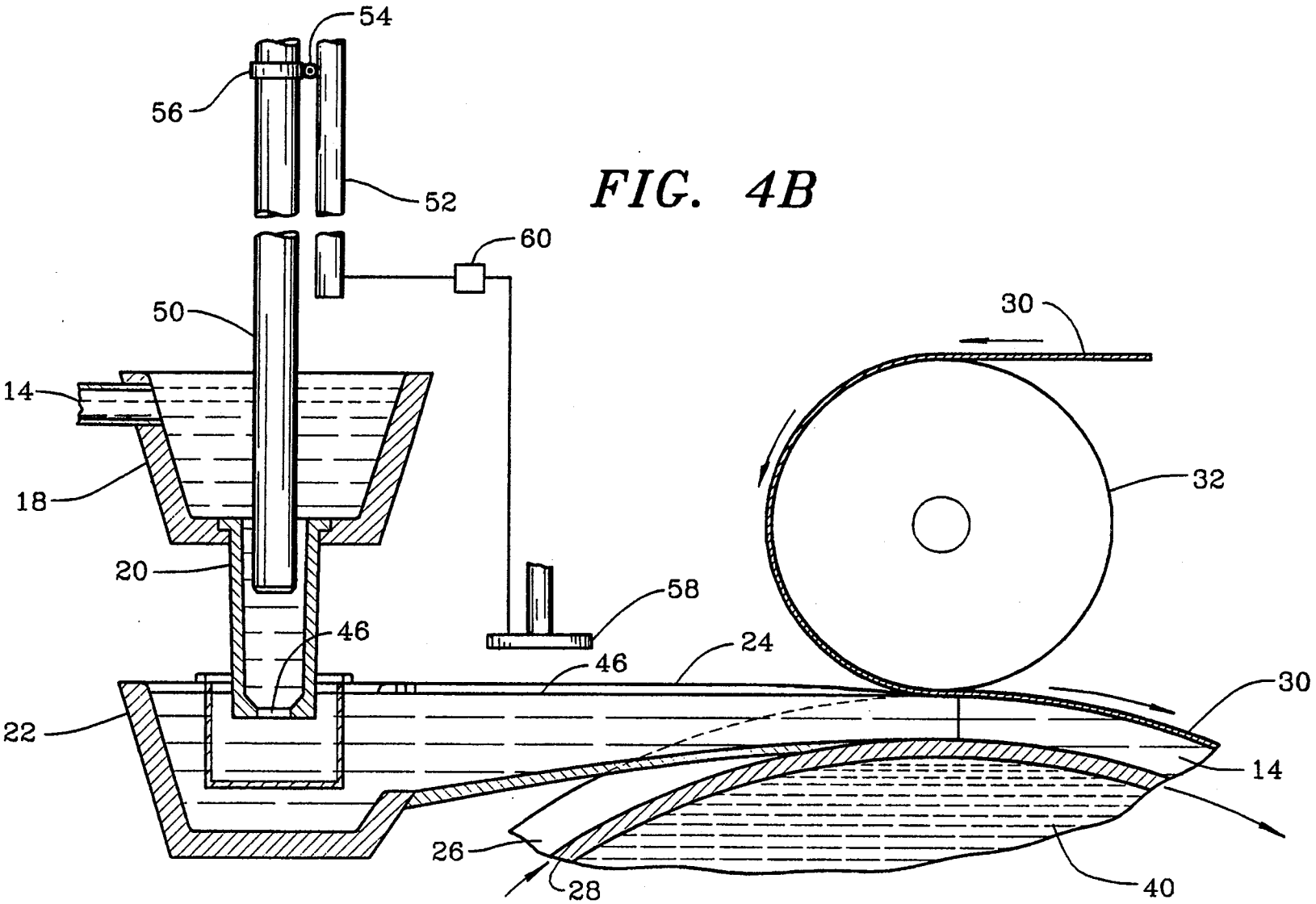
FIG. 4B corresponds to FIG. 4A but shows the units while molten metal is passing through the feeding means and into the casting wheel.
Figure 5:
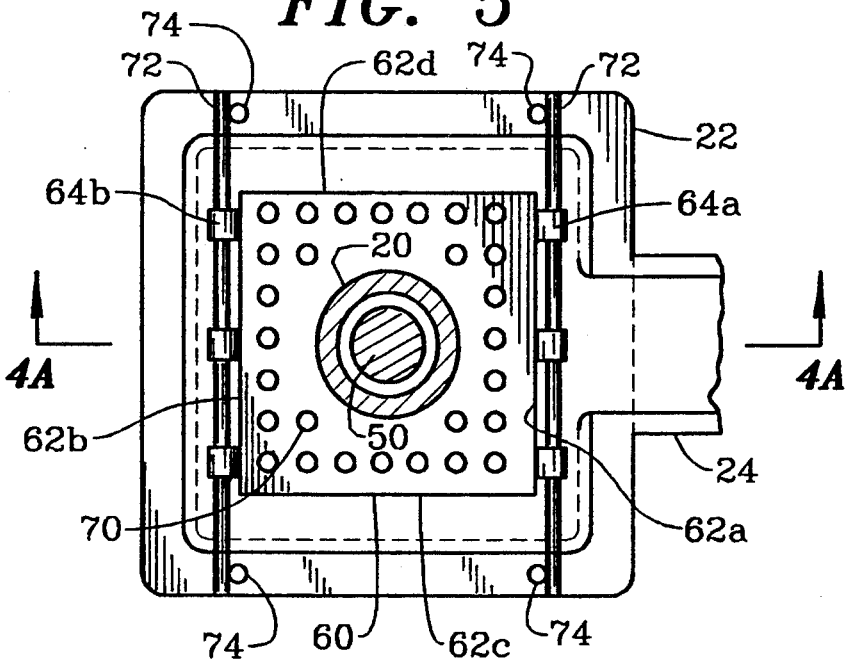
FIG. 5 shows an enlarged section through 5—5 in FIG. 4A.

Referring now to FIGS. 4A, 4B and 5, the lower end of spout 20 extends through the upper surface 42 of the molten metal 14 and lower tundish 22 and also in trough 24. Spout 20 has a slightly conical inner surface 44 which decreases in diameter towards an opening 46 through the lower end of the spout. An annular inward projection 48 of spout 20 extends around its opening 46 and provides a surface which fits against the lower end of a cylindrical control pin 50 when movement of molten metal through the spout is to be stopped. Raising and lowering pin 50 progressively increases and decreases flow through the spout, under control of an electro-mechanical actuator 52 which moves a vertically adjustable finger 54 connected to a collar fixed to pin 50 where it extends above upper tundish 18. Pin 50 extends below collar 56 through upper tundish 18 into spout 20.

A sensor 58 is mounted above trough 24 to register changes in the level of the upper surface 46 of molten metal 14 in the trough, by measuring the distance between the sensor and metal surface 46 through sensing changes in electrical capacitance or inductivity in the space between them. Electrical signals from the sensor are transmitted to a computer controlled instrument 60 connected to operate actuator 52 and thereby move pin 50 as needed to reach a desired level of metal surface 46.

Discharging spout 20 into lower tundish 22 while its chamber has only molten metal in it tends to produce strong currents of the metal which generate turbulence in the molten metal below sensor 58, to such an extent as to interfere with successful control of pin 50 by the sensor. This problem is overcome by mounting a foraminous receptacle 60 within lower tundish 22 below spout opening 46, so that all metal emerging from the spout must pass through the receptacle before passing out of lower tundish 18 into trough 24. By diffusing the outflow from within receptacle 60 through multiple openings through the receptacle, the flow of molten metal is passivated to such an extent that it does not develop undesirable turbulence in trough 24.

Figure 7:
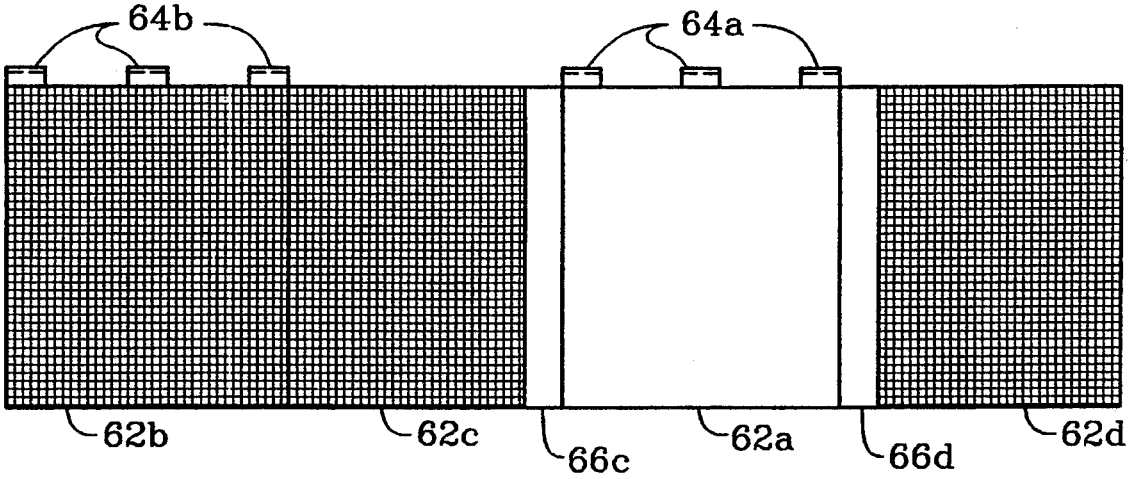
FIG. 7 shows four side walls of the foraminous receptacle, laid out flat after disconnecting one side seam.

Receptacle 60 has four side walls **62*a*–62*d* (FIG. 7) spaced inwardly from the corresponding four opposite side walls of lower tundish 22** (FIGS. 4A and 4B, and 5). The receptacle is preferably constructed of woven fiberglass fabric which is of relatively open mesh construction (for example, 8×8, which is eight strands per inch in each direction) where flow through the receptacle is desired, and tightly woven where flow through the receptacle is not desired.

The side wall **62*a* facing the entry to trough 24 is substantially impermeable to flow of molten metal 14 through it, and along its top edge has three support loops 64*a*. The opposite side wall 62*b* is of open mesh construction to allow controlled flow of molten metal through substantially its whole area, and along its top edge has three support loops 64*b*. The side walls 62*c* and 62*d* are opposite to each other and along their side edges are seamed to adjacent side edges of side walls 62*a* and 62*b*. The side wall 62*c* has a narrow rectangular panel 66*c* extending along its side edge seamed to a side edge of side wall 62*a*. The panel 66*c* is substantially impermeable to flow of molten metal through it and is of small area relative to the area of the whole side wall 62*c* (for example, about an eighth of the whole area). Side wall 62*d* has a like impermeable panel 66*d* along its side edge seamed to the adjacent side edge of side wall 62*a*. The areas of side walls 62*c* and 62*d* not occupied by panels 66*c* and 66*d* are of open weave construction like that side wall 62*b***.

Figure 6:
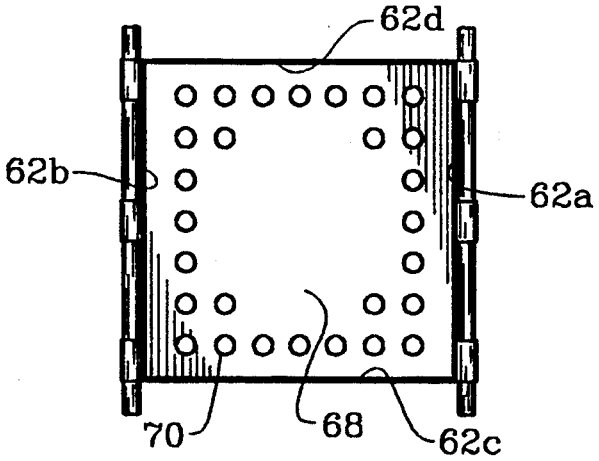
FIG. 6 shows a top view of the foramimous receptacle which is shown in FIGS. 4A and 4B mounted beneath a pouring spout.

Receptacle 60 is open at the top and is closed at the bottom by a horizontally extending wall 68 (FIGS. 5 and 6) which is seamed along its side edges to the bottom edges of side walls **62*a*–62*d*. Wall 68 is substantially impermeable to flow of molten metal except where pierced by openings 70 spaced around and away from its central area. Wall 68 is not only tightly woven but also preferably thicker than side wall 62*a* and panels 66*c* and 66*d***.

A pair of parallel spaced support rods 72 each extend through one of the sets support loops **64*a* and 64*b* and rest on top edges of opposite sides of lower tundish 22, to support receptacle 60. Upward projections 74 from said top edges bear against the ends of rods 72 to prevent them from moving toward each other from their positions where they hold receptacle side walls 62*a* and 62*b* apart and hold the upper edges of side walls 62*c* and 62*d*** straight to minimize sagging.

The open mesh construction of receptacle side walls **62*b*, 62*c* and 62*d* is suitable for adequate flow through, but with enough restraint to avoid turbulence that would interfere with operation of sensor 58 and its control of pin 50**. The mesh is sufficiently open to avoid filtering of solids in the melt enough to interfere with flow during normal continuous runs of a strand caster, which may last for more than a day.

While receptacle 60 is preferrably an open-mouth flexible fiberglass bag, it may also be made in whole or in part of rigid materials such as stainless steel.

While present preferred embodiments and methods of practicing the invention have been illustrated and described, it will be understood that the invention may be otherwise variously embodied and practiced without the scope of the following claims.

What is claimed is:

1. Apparatus comprising a casting wheel having a peripheral groove for receiving and solidifying molten metal, an upper chamber for receiving molten metal, a downspout from the upper chamber, a lower chamber to receive molten metal from the downspout, a trough extending laterally to convey molten metal from the lower chamber to the groove, means to regulate flow through the down spout, a sensor mounted above the trough to determine the level of molten metal in the trough, means connecting the sensor to operate the down spout flow control means, and means to prevent turbulence in the molten metal flowing through the trough beneath the sensor, said preventive means comprising a foraminous receptacle positioned in the lower chamber to receive molten metal from the down spout and cause it to pass through multiple openings through the receptacle before emerging from the receptacle.

2. Apparatus according to claim 1, in which said foraminous receptacle is open at the top and has side walls and a bottom wall which prevent outflow from the receptacle except through said walls, all but one of said side walls having most of its area formed of fabric having a weave open enough to permit flow of molten metal through the fabric with substantially no filtering effect on solids in the molten metal.

3. Apparatus according to claim 2 in which the bottom wall is of tightly woven fabric pierced by openings.

4. Apparatus according to claim 2, in which said one side wall faces the entry into said trough and is substantially impermeable to flow of molten metal through it.

5. Apparatus according to claim 1, in which the foraminous receptacle is of woven flexible construction.

* * * * *